US005280795A

United States Patent [19]

Leveque et al.

[11] Patent Number: 5,280,795

[45] Date of Patent: Jan. 25, 1994

[54] PROCESS AND CURLER FOR RESHAPING HAIR

[75] Inventors: Jean-Luc Leveque, Le Raincy; Frédéric Leroy, Saint-Cloud, France

[73] Assignee: L'Oreal, Paris, France

[21] Appl. No.: 873,779

[22] Filed: Apr. 27, 1992

[30] Foreign Application Priority Data

Apr. 30, 1991 [FR] France ..... 91 05289

[51] Int. Cl.[5] ..... A45D 7/02

[52] U.S. Cl. ..... 132/211; 132/235; 132/245

[58] Field of Search ..... 132/210, 211, 227, 229, 132/230, 233, 235, 245, 269

[56] References Cited

U.S. PATENT DOCUMENTS

| | | | |
|---|---|---|---|
| 1,520,968 | 12/1924 | Sartory | 132/235 |
| 2,652,839 | 9/1953 | Leclabert | 132/233 |
| 3,324,554 | 10/1967 | Solomon | 132/245 |
| 3,623,491 | 11/1971 | Garrett . | |
| 3,631,868 | 1/1972 | Solomon . | |
| 4,022,226 | 5/1977 | Meunstermann | 132/245 |
| 4,911,186 | 3/1990 | Hayden . | |
| 5,000,200 | 3/1991 | Roberts | 132/245 |
| 5,186,187 | 2/1993 | Roberts | 132/245 |

FOREIGN PATENT DOCUMENTS

| | | |
|---|---|---|
| 0171682 | 2/1986 | European Pat. Off. . |
| 2593361 | 7/1987 | France . |

*Primary Examiner*—Gene Mancene
*Assistant Examiner*—Frank A. LaViola
*Attorney, Agent, or Firm*—Cushman, Darby & Cushman

[57] ABSTRACT

According to the process for applying reshaping to hair by use of a hair-curler, the hair-curler (1) is arranged in such a way that the perimeter along which the lock of hair (M) is rolled increases by approx. 2 to 3% when its temperature rises to pass from a starting temperature to a higher temperature which nevertheless remains lower than a relatively low limit thus avoiding the burning of the hair and/or of the scalp; the longitudinal section of the curler is sufficient to withstand the stresses imposed by elongation of the lock of hair; the lock of hair is rolled around the curler at the starting temperature so that the hair is retained against the hair-curler; the curler is raised to the said higher temperature; the hair is thus subjected to elongation ensuring an increase in the life of the reshaping applied to the hair.

15 Claims, 1 Drawing Sheet

PROCESS AND CURLER FOR RESHAPING HAIR

The invention relates to a process for the application of a new style to hair (hereinafter known as restyling) using a hair-curler around which is rolled a lock of hair.

Such a process is used at present to create a wave in straight hair. To accentuate the wave effect, the hair in the wet state rolled around the hair-curler, may be subjected to heating either by way of a hair-drier or the like, or by means of the hair-curler itself, of the heat-store pipe.

A process of the same type may be used for straightening extremely waved hair, for instance 'frizzy' hair.

The purpose of the invention is particularly to provide a process of the type previously cited allowing a longer life of the restyling induced in the hair after unrolling from the hair-curler.

According to the invention, a process to apply reshaping to the hair by using a hair-curler is characterized by the fact that the hair-curler is arranged in such a way that the perimeter along which the lock is rolled increases by approx. 2 to 3% when the temperature passes from a starting temperature to a higher temperature which nevertheless remains below a relatively low level preventing the burning of hair and/or of the scalp, the longitudinal section of the hair-curler also being sufficient to withstand the stresses imposed by the stretching of the lock of hair; in that the lock of hair is rolled around the hair-curler at a starting temperature so that the hair may be retained against the hair-curler and the hair-curler is raised to the said higher temperature, the hair thus being subjected to elongation ensuring an increased life of the reshaping applied to the hair.

The said temperature limit is no higher than 60° C. and, preferably, the temperature allowing an increase of approx. 2 to 3% in the perimeter of the hair-curler is of the order of 40° C., when the starting temperature is equal to ambient temperature.

The hair-curler can be advantageously achieved at least in part, by means of a form-retaining material having a phase transition at a temperature below the said limit, the part of the hair-curler in form-retaining material is claimed so that the curler is transformed into a component of closely similar form, with a perimeter increased by approx. 2 to 3%, after passing the phase transition temperature in incremental values.

U.S. Pat. No. 4,911,186 patent already outlines a curler in form-retaining material; however this prior document only provides for the transition of a cylindrical shape curler, for hair rolling operations, to a flattened form facilitating storage.

There is no question of subjecting the hair to elongation by means of the curler.

The invention also relates to a curler for implementing the process previously defined, the curler being characterised by the fact that its outer surface presents a transverse section of effectively closed contour to allow rolling and securing of the lock on the curler, the surface having at least a longitudinal slot intended to allow an increase in cross-sectional perimeter, the curler having its own form-retaining material means to cause an increase of approx. 2 to 3% in the perimeter when the curler temperature passes from a starting temperature to a higher temperature after passing the phase transition temperature of the form-retaining material, the said higher temperature remaining below a limit temperature selected to avoid burning the air and/or the scalp, the longitudinal section of the curler being located to absorb the stresses imposed by elongation of the lock of hair.

Preferably the form-retaining material selected for the curler has a phase transition temperature of approx. 40° C., so that when the curler is raised to that temperature, the said increase in transverse section of the perimeter is obtained.

According to a first possibility, the curler consists of a longitudinally slit cylindrical component made of form-retaining material and which, when the temperature in the upwards direction passes the phase transition temperature, assumes a closely similar cylindrical form but with a perimeter increased by approx. 2 to 3%.

According to another possibility, the means consisting of form-retaining material comprise a helical roll of wire-thread of that material, and the curler has several plates made of inert material, located against the helical roll in such a way as to form a prism, the plates remaining free to move in relation to each other as they are separated by slots along their edges.

According to another possibility, the curler has a hollow cylindrical housing, with a longitudinal slit, of rigid elastic material whereas stress means consisting of form retaining material are placed at least partly inside the housing to cause an increase in its perimeter when the temperature passes by incremental values the phase transition temperature of the form-retaining material.

The stress means may consist of a plate of V-shape transverse section, located inside the housing and bearing with its longitudinal edges against the internal phase of the housing in essentially diametrically opposed areas, the plate being trained so as to tend to return to its plate condition after passing by incremental values the phase transition temperature of the form retaining material forming that plate, thus causing the opening of the outer housing and an increase in its diameter.

According to another possibility, the stress means comprise two tapering components with the hollow towards the outside and engaging at the points in each end of the longitudinally slit housing so as to come into contact with the edge of the end, the components being mechanically connected to each other by a rigid rod, the said tapering components being made of form-retaining material and being trained so as to tend to open after passing by incremental values the phase transition temperature, to cause the spreading of the housing against which they come to bear.

As a variation, the tapering components engaged by their point at each end of the housing and in contact by the edges of those ends are made of an inert material whereas a rod mechanically connecting the points of the taper components is made of a form-retaining material and has been trained in such a manner as to curve and cause the tapers to come closer together when the phase transition temperature of the form-retaining material has been passed by incremental values, thus causing an increase in the housing diameter.

The form-retaining material used here may be a metal alloy or synthetic resin, the phase transition temperature being advantageously located around 40° C.

Preferably, the form-retaining material will withstand a mechanical stress of 700 N/mm$^2$; the effective section of the curler will preferably exceed approx. 10 mm$^2$ thus allowing the rolling of a lock comprising up to approx. 5,000 individual hairs in a number of turns at most equal to four; for an elongation of the order of 2% the stress coming into play may be withstood by a curler having a housing made of such a form-retaining material.

The thickness of the housing will be between 0.2 mm and 4 mm approx.

The invention consists, setting aside the provisions outlined above, of a number of other provisions which will be more explicitly detailed hereinafter by way of typical examples described with reference to the appended drawings, though in no way of a restrictive nature.

FIG. 1*a* in the drawing is a cross section through a curler according to the invention, made of form-retaining material, in the unstressed condition at ambient temperature.

FIG. 1*b* is a cross-section through the same curler at a temperature higher than that of the phase transition.

FIG. 1*c* is a perspective of the curler in FIG. 1*a*, in the unstressed condition.

Figure 5:
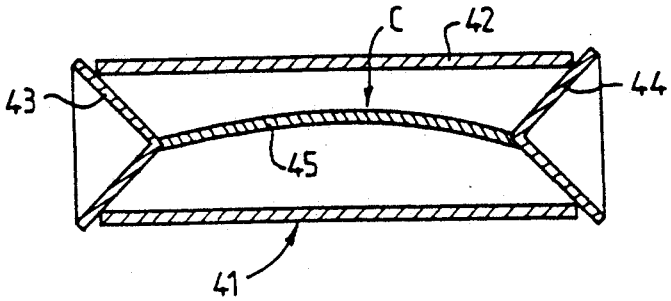

Finally, FIG. 5 is a longitudinal axial section through another variation.

Figure 1A:
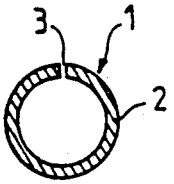
Figure 1B:
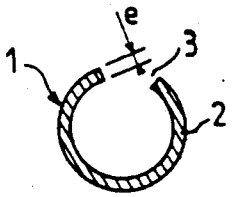
Figure 1C:
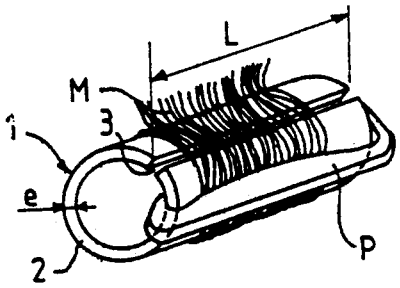

Referring to FIGS. 1*a* and 1*c* in the drawings, a rolling means 1 for a lock of hair may be seen, generally called curler, consisting of a hollow cylindrical shape component 2, having a longitudinal slit 3.

The slit cylindrical component 2 is made of a form-retaining material, more particularly a metal alloy or synthetic resin having that form retaining effect and with a phase transition temperature preferably of the order of 40° C. In the application envisaged here, the phase transition temperature should be lower than a relatively low limit, for instance of the order of 60° C., to avoid burning the hair or the scalp.

The component 2 is trained to transform itself, when the temperature is raised to a value exceeding the critical threshold constituted by the phase transition temperature, into a component of closely similar form of which the cross section shown in FIG. 1*b*, has a perimeter greater by approx. 2 to 3%. When passing the phase transition temperature level of the reverse direction by cooling, the component 2 passes from the form shown in FIG. 1*b* to that shown in FIG. 1*a*, i.e. returning to its initial form.

Such a perimeter increase of 2 to 3% represents a strong and sudden variation in dimension for a minimal temperature movement. This transformation can be reversed so that the initial dimensions of the component are resumed when it goes back to its starting temperature.

Such an increase is far in excess of that obtained by simple thermal expansion of a metal component, in such a limited temperature range.

In practice, if the cylindrical component 2 has an initial diameter of 20 mm, then a 2 mm increase in the width of the slit as the temperature increases to pass from ambient temperature to approx. 40° C., represents an increase of approx. 3% in the perimeter of the cross-section.

The hairs of the lock M rolled and held around the component 2 are thus subjected to an increase of 3% approx. corresponding with the perimeter variation of that cylindrical component 2.

The hairs of the lock M are held against the surface of component 2 in such a way as to follow the distortions, practically without slippage. Any known securing means can be used to hold the locks of hair rolled on the curler 2, such means consisting for instance of an elastic component P secured to one end of the curler. The other end of the curler may be retained by clipping or by a hook system with the other free end of the elastic component P intended to hold the locks of hair on the component 2.

The effective longitudinal section S of the curler, equal to the product of the length L by the thickness e ($S=L \cdot e$) is sufficient to withstand the stresses imposed by elongation of the lock of hair M.

The thickness e is preferably of the order of 0.2 mm, whereas the length L may be of the order of 50 mm which when the material forming the component 2 allows a maximum stress of the order of 700 $N/mm^2$, also allows up to four turns of a lock of 1,000 to 5,000 hairs to be rolled around the arrangement.

A calculation intended to specify these explanations is given below.

Assuming a component 2 with an initial diameter of 20 mm, at ambient temperature; the length L is 50 mm and the thickness is equal to e.

A lock of n hairs (n being less than 5,000) is rolled in t turns, t generally being equal to 4.

It may be assumed that the average diameter of a hair is 0.08 mm which gives an average section of $s=5.10^{-3}$ $mm^2$. As average rigidity module for a dry hair the value $Es=4{,}000$ $N/mm^2$ may be adopted, and for a wetted hair, the value $Eh=1{,}000$ $N/mm^2$, for up to an elongation of approx. 2% of the hair. Beyond that elongation the rigidity becomes extremely minimal.

The resistance of the lock of hair M when subjected to an elongation "epsilon" is equal to:

$F=[Es \cdot nt \text{"epsilon"}]$. This force is at its maximum when the hairs are dry; with the values given above, this force F reaches 8,000 N for "epsilon"=2%, t=4 turns and n=5,000.

The effective longitudinal section $L \cdot e$ of the roll arrangement 2 must therefore be in excess of approx. 11.5 $mm^2$, allowing for a maximum admissible stress of 700 $N/mm^2$.

This involves for a length L of 50 mm, a thickness e of approx. 0.23 mm.

To apply reshaping to hair by the use of curler 2 in FIGS. 1*a*, 1*c* the following procedure is adopted.

A lock of hair M, is rolled around the curler 2 at the starting temperature equal to ambient temperature, and holding the lock by clamping means, the lock is retained against the surface of the component 2 to prevent relative slipping of the hair.

The curler 2 and the lock M are then subjected to a temperature increase sufficient to pass the phase transition temperature of the material of component 2.

The cross-section of component 2 opens as shown in FIG. 1*b* causing the elongation of the hairs in lock M which in the example considered here, undergo an elongation of approx. 3% representing the variation in perimeter of-the cross section.

Such a reshaping is beyond the sliding threshold of the hair of the order of 2 to 2.5% elongation, causing an improved performance, particularly with regard to the life of the reshaping imposed on the hair.

Figure 2:
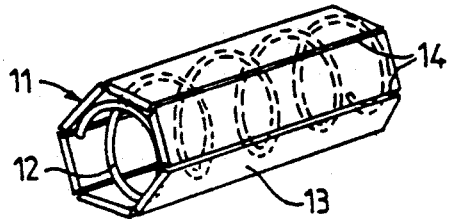
FIG. 2 is a perspective of a variation design of this curler.

According to the arrangement in FIG. 2, the curler 11 has a helical coil 12 of wire made of form retaining material. This coil is covered with several plates 13 forming a sought off prism, of hexagonal shape in the example shown here, separated from each other by longitudinal slot 14 extending along the edges of the prism. The plates 13 are made of an inert material and are free to move in relation to each other. The plates 13 are applied to the coil 12 by retaining means, not shown here, particularly elastic retaining means allowing an increase in section. The plates 13 are sufficiently resistant to prevent distortion and impose elongation on the lock of hair rolled around the plates. The plates 13 are fitted around the coil 12 in such a manner that they do not set up an effective resistance to the expansion of this internal coil 12.

The plates 13 are intended to prevent pinching of the hairs between the spirals of the coil 12.

Figure 3:
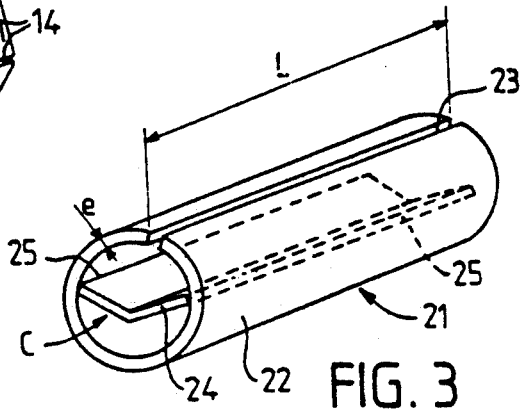
FIG. 3 is a perspective of another variation of the curler.

FIG. 3 shows a curler 21 comprising a longitudinally slit cylindrical component made of inert rigid elastic material. The slit 23 matches the slit 3 in FIG. 1*a*. The lock of hair is intended to be rolled around this component 22.

Stress means C of form-retaining material are placed inside component 22 to cause an increase in its perimeter when the temperature passes that of the phase transition.

In the example in FIG. 3, the stress means C consist of a plate 24 of V-shaped cross-section, placed inside the component 22 forming the housing and bearing by its longitudinal edges 25 against the internal surface of the housing 22 in essentially diametrically opposed areas. The plate 24 has been trained to resume the flat condition when the temperature raised by increasing values passes the phase transition temperature of the form-retaining material of which it is made. Such a reshaping causes the opening of the outer housing 22 and the widening of the slit 23 with an increase in the perimeter of the cross-section. The whole is arranged to achieve an increase of the order of 2 to 3%.

Figure 4:
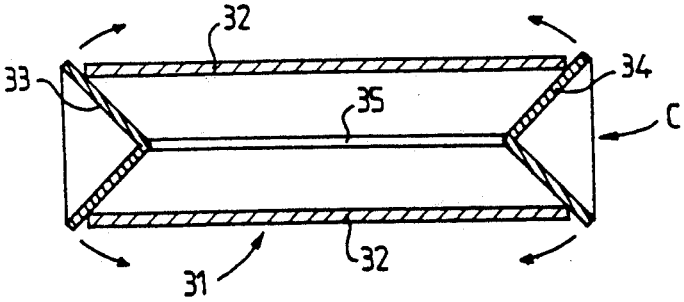
FIG. 4 is a longitudinal axial section through another variation of the curler.

According to the variation in FIG. 4, the curler 31 has a cylindrical component 32 forming a housing of inert material, as the component 22 in FIG. 3. This housing 32 has a longitudinal slit not visible in FIG. 4. The stress means C in the case of FIG. 4, comprises two tapering components 33, 34 located at each end of the housing 32, with their hollow towards the outside and their point on the inside of the housing. Each component 33, 34 is in contact with the edge of the end of the housing. These components 33, 34 are in form retaining material and are trained so as to tend to open on passing the phase transition temperature in increasing values. The points of the component 33, 34 are mechanically connected to each other by a rigid rod 35 of inert material.

When the temperature of the curler 31 passes from ambient temperature to a higher level while passing the phase transition temperature, the components 33, 34 open out, as shown by the arrows in FIG. 4, and by exerting a force on the ends of the component 32, cause this component to open thereby increasing its diameter and the perimeter of the cross section.

In the example in FIG. 5, the curler 41 has a cylindrical housing 42 in inert material complete with a longitudinal slit not visible in the drawing. This housing 42 is similar to the housing 22, 32 in FIGS. 3 and 4.

The stress means C comprise two tapering components 43, 44 in inert material, at each end of the housing 42 and with the hollow towards the outside. The point of components 43, 44 is located on the inside of the housing 42, the outer face these components bearing against the edge of the ends of the housing 42. The points of components 43, 44 located inside the housing 42 are connected to each other by mechanical means with a rod 45 of form retaining material. The rod 45 is trained in such a way as to curve and to cause the tapers 43, 44 to come together axially when passing in increasing values the material phase transition temperature. The force exerted by the tapers 43, 44 on the ends of the slit cylinder 42 causes an increase in the diameter of the housing 42.

Regardless of the arrangement adopted for the hair rolling means or curler, the hairs are rolled around the arrangement at ambient temperature then it is raised to a temperature preferably of the order of 40° C., to obtain an increase of approx. 2 to 3% in the perimeter of the arrangement.

The reshaping by elongation induced in the hairs, is beyond the hair sliding threshold (2 to 2.5% elongation) which improves the life of the hair reshaping.

In the case of straight hair subjected to a curling process, the curls thus produced last longer.

In the event of a decurling operation on the strongly curled hair (frizzy hair) the duration of the reshaping is also improved.

In the description of the examples, a hair curler exclusively intended to operate with a starting temperature equal to ambient temperature has been considered.

It is clear that the starting temperature may be lower than ambient temperature, whereas the higher temperature may be the ambient temperature. In such a case, the hair curler is kept before use at the (lower) starting temperature in a refrigerator, for instance at a temperature not exceeding 4° C. The rise in temperature then takes place without heating by the rise to ambient temperature.

We claim:

1. A process for reshaping the hair by means of a hair curler of a type having a perimeter about which the lock of hair is wrapped which perimeter increases from a starting diameter by approximately 2% to 3% as the temperature rises from a starting temperature that is no greater than ambient temperature to a selected higher temperature which is below a limit temperature, comprising the steps of using as the material of the hair curler a from retaining material having a phase transition temperature that is lower than said limit temperature and wherein the shape of the hair curler is retained as the temperature of the hair curler is increased from the starting temperature and passes through the phase transition temperature to increase the perimeter by approximately 2% to 3% and rolling a lock of hair about the perimeter of the hair curler while the hair curler is at the starting temperature, maintaining the hair wrapped about the perimeter of the hair curler while the temperature of the hair curler is raised to said higher temperature to increase the perimeter by approximately 2% to 3% to thereby subject the lock of hair to elongation to ensure an increase in duration of the reshaping applied to the lock of hair.

2. Process according to claim 1, characterized in that the said limit temperature is no higher than 60° C. and the temperature allowing an increase of approx. 2 to 3% in the perimeter of the curler is on the order of 40° C.

3. A hair curler having a perimeter about which a lock of hair is to be wrapped which perimeter increases from a starting diameter by approximately 2% to 3% as the temperature rises from a starting temperature to a selected higher temperature which is below a limit temperature, said hair curler comprising a form retaining material having a phase transition temperature that is lower than said limit temperature and wherein the shape of the hair curler is retained as the temperature of the hair curler is increased from the starting temperature to the selected higher temperature to increase the perimeter by approximately 2% to 3%, said hair curler having an outer surface having a closed contour and including at least one longitudinal slit to allow said increase in said perimeter.

4. Curler according to claim 3, wherein the form-retaining material is selected with a phase transition temperature of approx. 40° C.

5. Curler according to claim 3 wherein said hair curler comprises a component having a cylindrical form split longitudinally and which when the temperature rises and passes through the phase transition temperature, assumes a similar cylindrical form but with a perimeter increased by approximately 2 to 3%.

6. The hair curler as claimed in claim 3 wherein said hair curler includes a hollow cylindrical housing having a longitudinal slit, said housing being made of a rigid elastic material, stress means being located in said housing, said stress means being made of said form retaining material to increase the perimeter of said housing as said form retaining material has its temperature raised through the phase transition temperature.

7. Curler according to claim 6, wherein said stress means comprises a plate having longitudinal edges and a flat form with a V-formed cross-section, located inside the housing and bearing with its longitudinal edges against the internal surface of the housing in essentially diametrically opposed areas, the plate having been trained to resume its flat form when passing by incremental values the phase transition temperature of the form-retaining material constituting that plate, thus causing the opening of the outer housing and an increase in its diameter.

8. The hair curler as claimed in claim 3, wherein the thickness of the housing is between 0.2 and 4 mm approximately.

9. A hair curler having a perimeter about which a lock of hair is to be wrapped which perimeter increases from a starting diameter by approximately 2% to 3% as the temperature rises from a starting temperature to a selected higher temperature which is below a limit temperature, said hair curler comprising a form retaining material having a phase transition temperature that is lower than said limit temperature and wherein the shape of the hair curler is retained as the temperature of the hair curler is increased from the starting temperature to the selected higher temperature to increase the perimeter by approximately 2% to 3%, said form retaining material comprising a helical roll of wire, said hair curler having a plurality of plates of inert material placed against the exterior of said helical roll of wire to form a prism with said plates having longitudinal edges and being free to move in relation to each other and being separated by slots along said edges.

10. A hair curler having a perimeter about which a lock of hair is to be wrapped which perimeter increases from a starting diameter by approximately 2% to 3% as the temperature rises from a starting temperature to a selected higher temperature which is below a limit temperature, said hair curler comprising a form retaining material having a phase transition temperature that is lower than said limit temperature and wherein the shape of the hair curler is retained as the temperature of the hair curler is increased from the starting temperature to the selected higher temperature to increase the perimeter by approximately 2% to 3%, said hair curler including a hollow cylindrical housing having a longitudinal slit and opposite open ends, said housing being made of a rigid elastic material, stress means being located in said housing, said stress means being made of said form retaining material to increase the perimeter of said housing as said form retaining material has its temperature raised through the phase transition temperature, said stress means comprising two taper-formed components, each said component having a pointed end and a base end, each said pointed end being inserted into one end of said cylindrical housing, said taper-formed components being made of a form retaining material so as to open when the temperature thereof passes through the phase transition temperature to cause the spreading of the housing, said pointed end of said taper-formed components being mechanically connected to each other by a rigid rod.

11. A hair curler having a perimeter about which a lock of hair is to be wrapped which perimeter increases from a starting diameter by approximately 2% to 3% as the temperature rises from a starting temperature to a selected higher temperature which is below a limit temperature, said hair curler comprising a form retaining material having a phase transition temperature that is lower than said limit temperature and wherein the shape of the hair curler is retained as the temperature of the hair curler is increased from the starting temperature to the selected higher temperature to increase the perimeter by approximately 2% to 3%, said hair curler including a hollow cylindrical housing having a longitudinal slit and opposite open ends, said housing being made of a rigid elastic material, stress mean being located in said housing, said stress means being made of said form retaining material to increase the perimeter of said housing as said form retaining material has its temperature raised through the phase transition temperature, said housing having two taper-formed components, each said component having a pointed end and a base end, each said pointed end being inserted into one end of said cylindrical housing, said taper-formed components being made of an inert material, said pointed end of said taper-formed components being mechanically connected to each other by said stress means, said stress means comprising a rod made of form retaining material so as to open said housing when the temperature thereof passes through the phase transition temperature to cause the spreading of the housing by curving of said rod.

12. The invention as claimed in claim 11, wherein said form-retaining material is a metal alloy having a phase transition temperature of approximately 40° C.

13. The hair curler as claimed in claim 12, wherein said form-retaining material is capable of withstanding a mechanical stress of 700 $M/mm^2$ and the effective longitudinal section of the curler is in excess of approximately 100 $mm^2$.

14. The hair curler as claimed in claim 13, wherein the thickness of the housing is between 0.2 and 4 mm approximately.

15. The hair curler as claimed in claim 11, wherein the form-retaining material used is a synthetic resin having a phase transition temperature of approximately 40° C.

* * * * *